United States Patent [19]
Crump

[11] 3,949,497
[45] Apr. 13, 1976

[54] RELEASABLE LATCHING APPARATUS FOR A BENTHIC GRAB

[75] Inventor: Ben L. Crump, Freeland, Mich.

[73] Assignee: Trippensee Corporation, Saginaw, Mich.

[22] Filed: Aug. 23, 1974

[21] Appl. No.: 500,065

[52] U.S. Cl. ..... 37/71; 24/205.17; 37/54; 37/56; 37/183 A; 73/425.2; 175/253; 292/246; 294/70

[51] Int. Cl.[2] ..... G01N 1/12; E02F 3/44

[58] Field of Search..... 37/54, 56, 183 R, 183 A, 37/184, 71; 73/425.2; 294/70; 175/253; 24/205.17, 205.18, 205.19; 292/259, 246

[56] References Cited

UNITED STATES PATENTS

| | | | |
|---|---|---|---|
| 368,729 | 8/1887 | Morris | 37/183 A UX |
| 1,181,311 | 5/1916 | Huber et al. | 292/246 UX |
| 2,018,191 | 10/1935 | Schmidt | 292/246 |
| 3,509,772 | 5/1970 | Blair | 73/425.2 |
| 3,572,129 | 3/1971 | Walthier et al. | 73/425.2 |
| 3,633,965 | 1/1972 | Norman et al. | 24/205.17 X |
| 3,762,078 | 10/1973 | Wetherbee | 37/54 |

*Primary Examiner*—Clifford D. Crowder
*Attorney, Agent, or Firm*—Learman & McCulloch

[57] ABSTRACT

Releasable latching apparatus for a benthic dredge having closures latchable in open position, the apparatus comprising vertically displaceable latch pins coupled to a plunger which is vertically displaceable by a weighted messenger.

9 Claims, 4 Drawing Figures

RELEASABLE LATCHING APPARATUS FOR A BENTHIC GRAB

Latching apparatus according to the invention is especially adapted for use in conjunction with a benthic grab or dredge which is operable to obtain samples from the bottom of a body of water. A benthic grab or dredge conventionally has a hollow body open at both its upper and lower ends and mounts a pair of clamshell closures that are spring biased toward a position in which they close the bottom of the body. In the act of closing the closures cut a sample of the bottom of the body of water and retain the sample within the body. Such a grab also may have doors at the upper end of the body which are movable between open and closed positions and which preferably are biased toward their closed positions. The grab conventionally has its doors and clamshell closures latched in their open positions so that the grab may be lowered by means of a line to the bottom of a body of water. When the grab settles on the bottom, a heavy weight or messenger may be released for movement along the line into engagement with a latch release mechanism whereupon the doors and clamshell closures are released from their latched positions and are enabled to move to their closed positions, following which the grab may be hoisted to the surface for removal and analysis of the sample.

Releasable latch mechanism of the kind adapted for benthic dredges and the like have been complex, composed of many parts, and are difficult and costly to assemble. Furthermore, the complexities arising from the multiplicity of parts and the inevitable variations in the assembly of such parts have prevented the known latch release mechanisms from being as reliable as they otherwise might be.

The principal object of this invention is to provide a releasable latch mechanism for benthic grabs and which is composed of fewer parts then mechanisms and apparatus heretofore used for similar purposes, thereby providing a more reliable and less expensive apparatus.

Other objects and advantages of the invention will be pointed out specifically or will become apparent from the following description when it is considered in conjunction with the appended claims and the accompanying drawings, in which:

Figure 1:
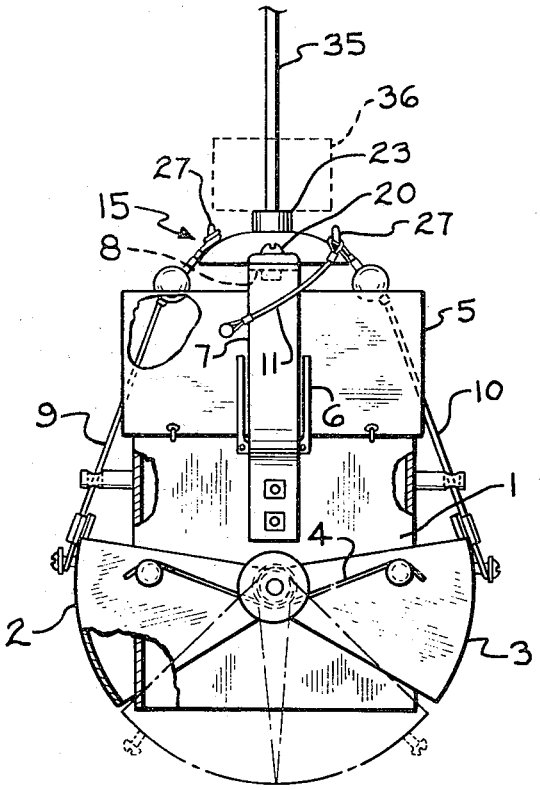
FIG. 1 is a side elevational view, partly in section, of a benthic grab fitted with releasable latch apparatus constructed in accordance with the invention.
Figure 2:
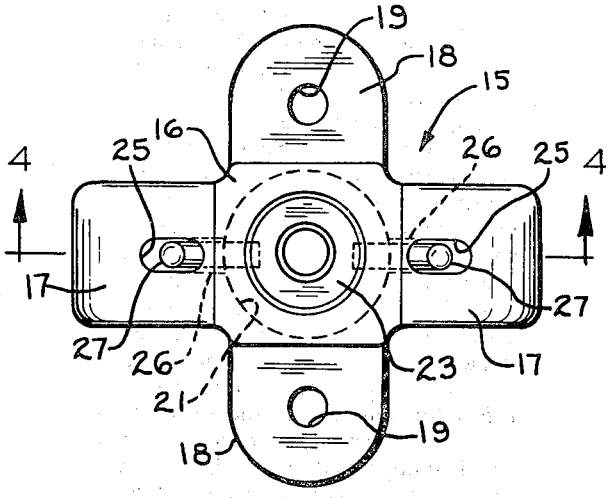
FIG. 2 is a top plan view of the latch apparatus.
Figure 4:
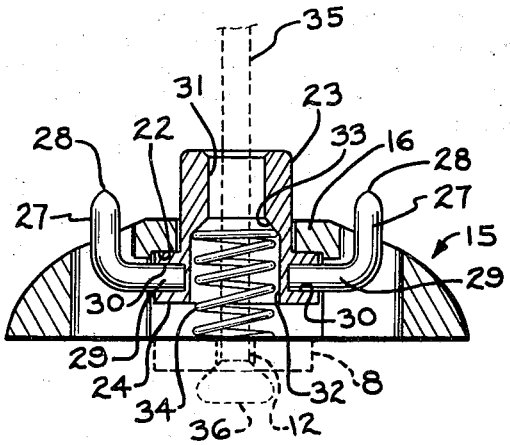
FIG. 4 is a sectional view taken on the line 4—4 of FIG. 2.
Figure 3:
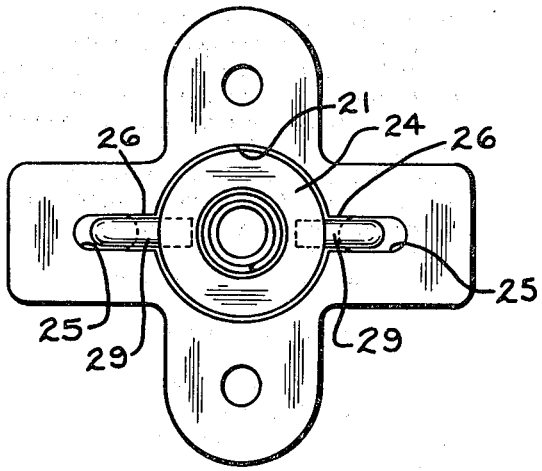
FIG. 3 is a bottom plan view of the latch apparatus.

Latching apparatus constructed in accordance with the invention is particularly well adapted for use in conjunction with a benthic grab or dredge of the kind disclosed in U.S. Pat. No. 3,762,078, granted Oct. 2, 1973, and to which reference may be had for a more detailed disclosure. Briefly, however, the grab has a hollow body 1 open at both its top and bottom, the bottom being adapted to be closed by a pair of clamshell closures 2 and 3 biased to their closed positions by a torsion spring 4. The top of the body 1 is adapted to be closed by doors 5 that are biased to their closed positions by springs 6. Secured to the body 1 adjacent the upper end thereof is a bail 7 having a substantially horizontal web 8 spanning the width of the body 1. The web 8 has an opening 12 at its center.

One end of a cable 9 is secured to the clamshell 2 and a similar cable 10 is secured to the clamshell 3. One end of a cable 11 is secured to one of the doors 5, and a similar cable is secured at one end to the other door. Each of the cables terminates at its other end in an anchor loop, the purpose of which will be explained subsequently.

Latching apparatus constructed in accordance with the disclosed embodiment of the invention comprises an elongate body 15 having a thickened, central portion 16 from opposite ends of which extend tapering wings 17. The central portion 16 of the body also preferably has a pair of mounting ears 18 provided with an opening 19 for the accommodation of a bolt 20, by means of which the body 15 may be mounted on the web 8 of the bail 7.

The central portion 16 of the body 15 has a cylindrical cavity 21 therein which is open at opposite sides of the body. Adjacent the upper side of the body is a circular lip 22 which overhangs the cavity for a purpose presently to be explained.

Slidably fitted into the cavity 21 is an operator or plunger 23 having adjacent its lower end an annular flange 24 that is adapted to engage the lip 22. Although the plunger 23 is freely slidable in the cavity 21, the relative sizes of the latter and the plunger are such as to preclude any substantial tilting of the plunger, thereby avoiding binding of the plunger.

Each of the tapered wings 17 of the body 15 has an opening 25 which parallels, but is spaced from the cavity 21. Each opening 25 extends completely through its associated wing 17 and communicates with the cavity 21 via a channel 26 which is open at the lower side of the body.

Slidably accommodated in each of the openings 25 is a latch pin 27 having a smoothly rounded nose 28 at one end. Each pin 27 is bent at a right angle between its end to form a coupling stem 29. Each stem is accommodated in an opening 30 formed in the flange 24 of the plunger 23, thereby coupling the pins 27 and the plunger 23 for conjoint movement. The diameter of each pin 27 is sufficiently smaller than the width of the corresponding opening 25 and the channel 26 so as to permit free sliding movement of the pin, but the diameter of each pin is such as to prevent any substantial rocking movement thereof relatively to the plunger 23.

The plunger 23 has at its upper end a bore 31 which communicates with a counterbore 32, the juncture of the bore and counterbore forming a shoulder 33 between the ends of the plunger. Accommodated in the bore 32 is a compression spring 34 one end of which seats upon the shoulder 33 and the opposite end of which is adapted to seat upon the web 8 of the bail 7.

To condition the apparatus for use, the plunger 23 is fitted with the latch pins 27 and the spring 34 is fitted into the counterbore 32. The assembly then is placed atop the web 8 of the bail 7 with the counterbore 32 aligned with the opening 12 in the web 8. The body 15 then may be secured to the web 8 by means of the bolts 20, whereupon the spring 34 will react between the web 8 and the shoulder 33 so as yieldably to maintain the plunger 23 in a normal or latching position in which the shoulder 24 abuts the lip 22. In this position of the plunger the latch pins 27 protrude beyond the wings 17 a distance sufficient to extend through the anchor loops at the free ends of the cables 9, 10, and 11.

A hoisting line or cable 35 is threaded through the opening 12 in the web 8, through the spring 34, and through the bore 31 and the counterbore 32. The lower end of the cable 35 is provided with a stop or enlargement 36 of such size as to be incapable of passing through the web opening 12.

When it is desired to take a sample from the bottom of a body of water with the disclosed grab, the clamshell closures 2 and 3 will be rocked to their open positions and may be latched in such positions by securing the anchor loops at the ends of the cables 9 and 10 over the anchor pins 27. The doors 5 will be swung to their open positions and may be maintained in such positions by fitting the loops at the ends of the cables 11 over the respective latch pins 27. The grab then may be lowered to the bottom of the body of water by means of the line 35. When the grab rests upon the bottom, a heavy weight or messenger may be threaded onto the line 35 and released so that it falls by gravity toward the grab.

In the normal or latching position of the latch pins 27 the upper end of the plunger 23 lies in the path of downward movement of the messenger 36 so as to be struck by the latter. Engagement of the messenger with the plunger 23 will displace the latter downwardly as is permitted by the yieldable spring 34, thereby effecting corresponding movement of the latch pins 27 so as to retract them into the openings 25. As the pins 27 are retracted into the openings, the anchor loops of the cables will engage the upper surface of the wings 17 and will be stripped off the latch pins, thereby enabling the springs 4 and 6 to move their respective closures to their closed positions. The grab then may be raised by means of the line 35.

The close fit of the plunger 23 within the cavity 21 assures axial movement of the plunger relatively to the body 15 even though the line 35 may be at an angle to the vertical due to water current. Axial movement of the plunger 23, assuming that the messenger 36 of the proper weight has been chosen, virtually assures release of the latching mechanism so as to effect closing of the grab's closure members.

The disclosed embodiment is representative of the presently preferred form of the invention, but is intended to be illustrative rather than definitive thereof. The invention is defined in the claims.

What is claimed is:

1. Releasable latching apparatus for a benthic grab or the like comprising a body having therein a cavity, at least one opening substantially parallel to and spaced from said cavity, and a channel establishing communications between said cavity and said opening; a plunger member accommodated in said cavity for movement inwardly of said body from a normal position projecting beyond one end of said cavity; a latch member having a free end accommodated in said opening for movement inwardly of said body from a normal latching position in which said free end protrudes beyond said body to an unlatching position; means accommodated in said channel spanning the distance between said plunger member and said latch member at the opposite end of the latter and coupling said members for conjoint movement; and yieldable means acting on at least one of said members and yieldably biasing the latter to its normal position.

2. Apparatus according to claim 1 wherein said yieldable means acts on said plunger member.

3. Apparatus according to claim 1 wherein said plunger member has a bore therethrough for the accommodation of a hoist member.

4. Releasable latching apparatus for a benthic grab or the like comprising an elongate body having a cavity extending therethrough from one side to the other; a plunger member accommodated in said cavity for movement axially of said cavity, said body having a pair of openings therein spaced from and substantially parallel to said cavity and located on opposite sides of the latter; a pair of latch members, one of which is accommodated in one of said openings and the other of which is located in the other of said openings; means coupling said latch members and said plunger member for conjoint movement; and yieldable biasing means acting on said plunger member and biasing the latter toward a normal position in which said latch members protrude beyond one side of said body, the yieldability of said biasing means enabling movement of said plunger member from said normal position in a direction to effect movement of said latch members toward the opposite side of said body.

5. Apparatus according to claim 4 including cooperable means on said body and said plunger member and engageable with one another to define said normal position.

6. Apparatus according to claim 5 wherein said cooperable means comprise a flange on said plunger member and lip overhanging said cavity.

7. Apparatus according to claim 4 wherein each of said latch members comprises a pin.

8. Apparatus according to claim 4 wherein said body has channels therein establishing communication between said cavity and each of said openings.

9. Apparatus according to claim 8 wherein said coupling means is accommodated in said channels.

* * * * *